169-46 SR
2/1/77 OR 4,005,754

United States Patent [19]
Linden et al.
[11] 4,005,754
[45] Feb. 1, 1977

[54] PROCESS FOR THE AUTOMATIC REPORTING AND EXTINGUISHING OF FIRES

[76] Inventors: Gerhard Linden, von-Werth-Str: 5-7, 5 Cologne 1; Dierk Lay, Im Thurnerfeld 60, 5 Cologne 80; Karl Tiedtke, Zanderstrasse 37, 5203 Much, all of Germany

[22] Filed: Mar. 6, 1975

[21] Appl. No.: 555,987

[52] U.S. Cl. ..... 169/46; 169/61; 169/23; 340/227 R

[51] Int. Cl.[2] ..... A62C 37/04

[58] Field of Search ..... 169/43, 46, 54, 56, 169/60, 61, 23; 340/418, 228 S, 227 R

[56] References Cited

UNITED STATES PATENTS

| | | | |
|---|---|---|---|
| 3,544,792 | 12/1970 | Giltaire | 340/227 R X |
| 3,713,491 | 1/1973 | Grabowski et al. | 169/61 |
| 3,750,161 | 7/1973 | Teeters | 340/418 |
| 3,865,192 | 2/1975 | Dunphy | 169/61 |
| 3,866,687 | 2/1975 | Banner | 169/26 X |

*Primary Examiner*—Evon C. Blunk
*Assistant Examiner*—Michael Mar
*Attorney, Agent, or Firm*—Laurence & Neilan

[57] ABSTRACT

A process for the automatic reporting and extinguishing of fires and an automatic fire reporting and extinguishing system capable of performing such process are provided. The process uses at least two different types of fire reporting devices and requires a signal from each type of device in order to respond by releasing extinguishing agent. This requirement eliminates many false alarms and unnecessary releasing of extinguishing agent. According to the process extinguishing agent is released in a predetermined quantity and then a check is made to determine whether the fire has been extinguished. If the fire is not extinguished, another quantity of extinguishing agent, equal to the first, is released. Succeeding quantities of extinguishing agent are released until the fire is extinguished or the extinguishing agent is spent.

9 Claims, 5 Drawing Figures

PROCESS FOR THE AUTOMATIC REPORTING AND EXTINGUISHING OF FIRES

The invention relates to a process for the automatic reporting and extinguishing of fires. It refers moreover to locally fixed fire extinguishing installations to carry out such a process.

Processes for the automatic reporting and extinguishing of conflagrations have been known for a long time and are being used for many years in the case of locally fixed fire extinguishing installations. Such installations operate with the most diverse extinguishing means, for example, with water, as in the case of sprinkler and spraying water extinguishing installations, with carbon dioxide, with foam and in most recent times with halogenated hydrocarbons. These extinguishing installations of the type in which fire reporting devices control the extinguishing installation and put in into operation, have proven their worth in many individual cases.

Extinguishing installations which have been conceived hitherto are nevertheless still imbued with disadvantages of various kinds.

Extinguishing installations with only a limited quantity of extinguishing agent, for example, carbon dioxide extinguishing installations, will bring the desired result only whenever in the case of planning of these installations all local factors, for example, utilization of the spaces to be protected, will be considered correspondingly and correctly whenever the value of influence on which the calculations are based do not change in the case of completed installations, and the extinguishing starts at the point in time at which a successful extinguishing is possible.

Hitherto, in some cases, it was hoped that one could meet the danger of the insufficient automatic extinguishment through the fact that extinguishing means were stored in addition to the actual quantity of extinguishing agents, which quantity could then be released by hand. Premise for the successful extinguishing however is that human assistance is available at the right moment which is quaranteed only in very few cases.

In the case of extinguishing installations with limited or unlimited quantities of extinguishing agent, which quantities are controlled for the purpose of as early as possible fighting of the fire by sensitive automatic fire reporting devices, for example, smoke reporting devices, for example, spray-water extinguishing installations, great damage can occur on the one hand in the case of faulty alarms given by the reporting devices as a result of discharging extinguishing agents, and on the other hand in the case of only a limited quantity of extinguishing agent, said extinguishing agent can be released so that the extinguishing installation is not ready for use during the time of replenishment of the extinguishing agent. In order to prevent faulty triggerings of extinguishing installations in the case of response by fire reporting installations not according to their specification, reporting installations nowadays are already constructed technically in such a way, that it will have been necessary for two reporting installations to respond before the extinguishing installation will function automatically. In this manner faulty triggerings of extinguishing installations can be reduced to be sure, but they can still not yet be reduced to a sufficiently small measure.

In the case of extinguishing installations with practically unlimited quantity of extinguishing agent and the extinguishing agent of water, for example, sprinkler installations, disadvantages can result from the fact that the installation is not turned off in good time after the extinguishing process has been completed and that extinguishing agent discharging unnecessarily causes even more damage.

Therefore, the invention is based on the task of creating a safe process for the automatic reporting and extinguishing of fires as well as an automatic fire extinguishing installation which in the case of fires will release the extinguishing agent from the extinguishing agent supply always and only whenever the circumstances of the fire require it and which shuts down the extinguishing installation whenever the extinguishing is completed.

As a solution of this task and according to the invention a process for the automatic reporting and extinguishing of fires is proposed, the technical concept of which consists in the fact that the extinguishing installation is controlled and operated only after a reporting installation for flames, which previously had been put into the state of readiness to respond by smoke reporting installations which have responded twice or by a heat reporting installation which has responded once, delivers a report of a fire, whereby the reporting installation for the flames checks the success of the extinguishing action at certain time intervals and either shuts off the extinguishing installation or calls for additional extinguishing agents for a secondary extinguishing.

The process according to the invention for the automatic reporting and extinguishing of fires can be put to use in the case of extinguishing installations with open nozzles and limited supply of extinguishing agent, for example, in the case of carbon dioxide fire extinguishing installations, in the case of extinguishing installations with open nozzles and unlimited supply of extinguishing agent, for example, in the case of extinguishing installations with spraying water as well as in the case of special extinguishing installations with closed nozzles of the case in which every closure itself is a fire reporting installation, for example, in the case of preaction sprinkler installations.

As a result of the process according to the invention, the effectiveness and reliability of automatic extinguishing installations will be increased considerably. For example, the following advantages will result:

As a result of the fact that the occurrence of the fire itself determines the necessary quantity of extinguishing agent and thus within certain limits the concentration of extinguishing agent in the spaces to be protected, the mathematically determined construction of extinguishing installations with open nozzles and only with limited supply of extinguishing agent for certain risks, the requirement for extinguishing agent of which has not yet been proved by experience, will not lead to a failure whenever for lack of knowledge of the necessary quantities of extinguishing agent too low concentrations of extinguishing agents had been selected because as a consequence of the principle of the automatic secondary extinguishing according to the invention, the extinguishing process will be repeated at the correct time in case of need and an additional definite quantity of extinguishing agent will be released from the supply of extinguishing agent, which increases the concentration of extinguishing agent in the area of extinguishing.

Faults in the calculation of the quantities of extinguishing agent to be used for the risks which have been under control for a long time and concerning which alot of experience is available, but which are not recognized in the case of a recheck, do not jeopardize the success of extinguishing, because the extinguishing installation according to the invention will always call forth automatically as much extinguishing agent as is required for successful extinguishing. The harmful influences of changes in the utilization of buildings or enclosed spaces, which for example result from the storing of materials with a different fire behavior or as a result of a change of the structural premises, for example, openings in the walls and ceilings, and which in the case of the present-day automatic extinguishing installations with a limited supply of extinguishing agent lead to the fact that the automatically calculated quantity and concentration of extinguishing agent cannot control the occurrence of the fire, are excluded in the same way. As a result of the process according to the invention, it will moreover be guaranteed that the extinguishing will not start at the point in time at which no extinguishing is necessary, that is to say one will avoid that upon the first signs of smoke the requirement of extinguishing agent will be called forth without the conflagration being extinguished with this quantity to such an extent that later on a flairing up would not be possible and that then no more extinguishing agent would be available at that time.

In the case of installations with practically unlimited supply of extinguishing agent and with open nozzles, for example, spraying water extinguishing installations, the frequency of faulty releases and thus the frequency of the discharge of water for extinguishing according to determination will be considerably decreased in the case of application of the process according to the invention. Similar advantages result whenever the process according to the invention is used in so-called pre-action sprinkler installations, in the case of which the water for extinguishing because of danger of freezing or for fear of possible water damage due to breakdowns, is brought up to the nozzles for the extinguishing agents only in the case of fire. In this case, frequently the emptying of the network of pipes necessary in the case of a response not according to determination of the hitherto existing pre-action sprinkler installations, is eliminated.

With the process according to the invention, it will also be possible to deduce criteria which will record whenever a fire has been extinguished completely, that is to say it can be determined when there is no need any longer for supplying any further extinguishing agent. This is very important in the case of installations with practically unlimited supply of extinguishing agent, for example, in the case of spraying water extinguishing installations, sprinkler installations, in order to avoid considerable damage from water. This advantage of the automatic shut off of the supply of extinguishing agent is not neutralized by the fact that an automatic fire extinguishing installation according to the invention will stop its action too soon and the conflagration can then spread unimpeded, because the extinguishing installation according to the invention will immediately start again whenever the reporting system, to put it more precisely, the reporting installation for flames, again issues a report of a fire.

The process according to the invention is compatible with the basic concept of hitherto existing automatic fire extinguishing installations. Thus in the case of its use, it is not necessary among other things to increase the supply of extinguishing agent and the concentration of extinguishing agent altogether to a multiple. Thus for the extinguishing installation according to the invention no basic increase in expenditure is necessary in order to guarantee the effectiveness of extinguishing of the installation even in the case of special cases which could not have been foreseen. Therefore, these advantages mentioned do not have to be purchased by an expensive installation which is decisive for the economy of the extinguishing installation according to the invention. It will furthermore be advantageous that already existing extinguishing installations can be changed over without great expenditures so that they too will obtain the stated advantages. In order to realize the invention it will be possible in the case of hitherto automatic fire extinguishing installations that the part for the recognition of the fire will remain largely unchanged and the part for the extinguishing installation will remain unchanged. The control for the extinguishing installation must be changed.

In the case of extinguishing processes according to the invention as well as in the case of the assigned extinguishing installation, a special control and regulating arrangement is required between the arrangement for the reception of the fire reports, for example, a central office for fire reports, and of the extinguishing installation, which arrangement makes necessary that the fire report in every extinguishing area (fire area) takes place at least over two separate reporting lines. Reporting devices of one type of reporting, for example, smoke reporters, heat reporters, flame reporters, can be used only per reporting line. Flame reporters and to be sure infrared flame reporters must be connected to one of these reporting lines. In the second reporting line the connection of smoke reporters or heat reporters or combinations of these types of reporting are necessary in the second reporting line depending on the type of fire risk. It is characteristic for the process according to the invention for the automatic reporting and extinguishing of fires, that the fire report of the smoke or heat reporters is a premise for the response of flame reporters, that is to say that its response will only be taken into consideration as a criterion for the fire, whenever a heat reporter has responded previously or whenever a smoke reporter has given a second fire report after disregard of the first fire report. Responding flame reporters are reset immediately after the fire report insofar as a fire report had not been made previously at least twice by a smoke reporter or once a fire report by a heat reporter. This solution was selected in order to exclude any possible faulty alarms of the flame reporters which can occur over extended periods of time as a result of influences of some foreign radiation and which however are far less probable in the case of shorter time intervals, as a partial criterion for the triggering of extinguishing installations. A one time disregard of fire reports which were rendered by smoke reporters has been provided for the same reason. The second fire report of at least one smoke reporter or the first fire report of at least one heat reporter are recorded at a suitable place and lead to notification of the authorities to render assistance, for example, the fire brigade. In the case of heat reporters therefore the calling out of extinguishing forces takes place already after the first response.

Whenever the criteria for the control of the extinguishing installation exist, then immediately a preliminary warning is issued insofar as the extinguishing agent can endanger individuals, for example, in the case of carbon dioxide fire extinguishing installations. After conclusion of the preliminary warning or immediately without any preliminary warning in the case of installations with extinguishing agents which are not dangerous for human beings, the extinguishing installation is triggered by the control and regulating arrangement. In the case of extinguishing installations with open nozzles and limited supply of extinguishing agent, the released quantity of extinguishing agent is sized such that it is to take care of the extinguishing. In the case of these installations, the success of extinguishing is checked with the aid of a flame reporter after a certain action time of the extinguishing agent, for example, 10 seconds. Whenever a flame reporter finds that after this time its conditions for response are still fulfilled, that is to say that flames still exist, then immediately and according to the invention a second installment of extinguishing agent is released, which agrees in size with the quantity of the first application of extinguisher. If even this second application of extinguishing agent should still be without success, then according to the invention a renewed extinguishing takes place automatically until the supply of extinguishing agent is exhausted.

The automatic shutting off of the supply of extinguishing agent, for example, in the case of spraying water or sprinkler installations, is realized in the case of the process according to the invention through the fact that the absence of the fire reports by flame reporters is evaluated as a criterion for the success of the extinguishing action and the closing of the locking valves is brought about.

The invention will be shown schematically in the figures on the basis of the embodiment shown by way of example and in more detail.

Figure 1:
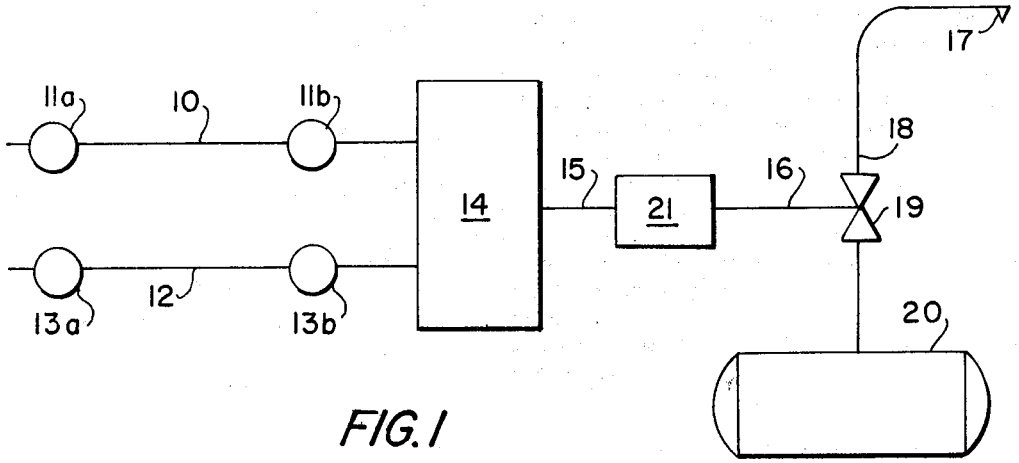
FIG. 1 shows roughly schematically an overall installation for the automatic extinguishing of a fire with a limited supply of extinguishing agent and open extinguishing nozzles.

The automatic fire extinguishing installation according to FIG. 1 has a reporting line 10 with two smoke reporters or two heat reporters 11*a* and 11*b*, as well as a reporting line 12 with two infrared flame reporters 13*a* and 13*b*. Both reporting lines 10 and 12 lead to the installation 14 which evaluates the fire reports, for example, central office for fire reports. The right-hand side of FIG. 1 shows in a simplified manner a stationary fire extinguishing installation with an open nozzle 17 which is connected with the supply tank 20 for the extinguishing agent by way of an extinguishing agent pipe 18 and a closing element 19, in which supply container there is a limited supply of extinguishing agent. According to the invention, a control and regulating arrangement 21 is switched in between the arrangement 14 and the closing element 19 by way of the lines 15 and 16, across which regulating arrangement the closing element 19, for example, a magnetic valve, is controlled. The stored quantity of extinguishing agent can be released from the extinguishing agent tank 20 by way of the locking element 19.

Figure 2:
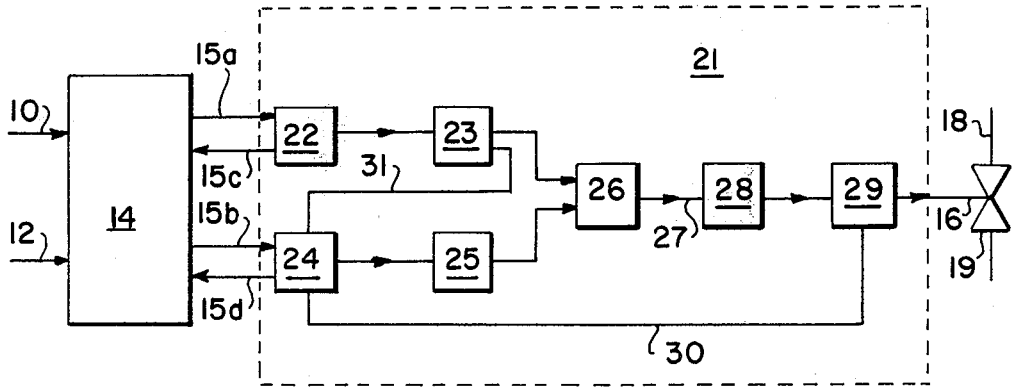
FIG. 2 shows the control of the extinguishing installation of FIG. 1.

The arrangement 21 is described in more detail in FIG. 2. It contains an arrangement 22 for disregarding (setting back) of fire reports of the smoke or heat reporters and an arrangement 24 for disregarding of fire reports of the flame reporters. The arrangement 22 is connected by way of lines 15*a* and 15*c* with the arrangement 14, and the arrangement 24 is connected with the arrangement 14 by way of the lines 15*b* and 15*d*. The fire reports which are delivered by the smoke or heat reporters and by the flame reporters by way of the reporting lines 10 and 12 to the arrangement 14 are delivered by way of the lines 15*a* and 15*b*, are passed on to the disregarding installations 22 and 24 which, after a brief predetermined time, again bring about the return of the fire reports in the arrangement 14 by way of the lines 15*c* and 15*d*. The return as a result of arrangement 22 will be omitted however, whenever heat reporters are connected in the reporting line 10 or else in the case of smoke reporters in this reporting line for the second fire report. Fire reports not returned from the reporting line 10 are stored in the arrangement 23 for a predetermined time. Fire reports from the reporting line 12 are returned, and this by the arrangement 24, basically until a fire report from the reporting line 10 has been stored in the arrangement 23. The not returned fire reports from the reporting line 12 are received in the arrangement 25. If at the same time, fire reports have been stored in the arrangements 23 and 25, then the arrangement 28 will be controlled by way of line 27 from the arrangement 26. The arrangement 28 is a customary arrangement for the delay of extinguishing for a certain time in the case of carbon dioxide extinguishing installations, which is necessary for abandoning the extinguishing areas. After completion of a predetermined delaying time, during which the alarm is sounded in the extinguishing area (fire area), this arrangement passes on the extinguishing process to the closing element 19 for the extinguishing agent by way of arrangement 29 which likewise is used in customary carbon dioxide extinguishing installations and which serves for the determination of the rate of the extinguishing agent. Immediately after completion of the predetermined time for the outflow of the first quantity of extinguishing agent, the fire report of the flame reporter in storage 25 is cancelled and the flame reporters are reset for the duration of the action period of the extinguishing agent. After that, the success of extinguishing is checked with the help of the flame reporters. The latter will report flames even if smoke is present. Whenever one of the flame reporters finds that its conditions for response are still fulfilled, that is to say whenever flames are still present, the control of the locking element 19 is immediately repeated and its second quantity of extinguishing agent is released. Even if after this second extinguishing effort the success of extinguishing is still lacking, a secondary extinguishing is continued automatically as long as the supply of extinguishing agent in tank 20 lasts.

The (delaying) arrangement 28 is not needed in the case of extinguishing installations with water as an extinguishing agent because this extinguishing agent is not dangerous for human beings. For the control of such installations, for example, spraying water extinguishing installations, the command for extinguishing is fed directly to the installation 29. Here, however, the disregarding of the fire report of the flame reporters is caused already during the extinguishing process and to be sure a short time after the beginning of extinguishing, by way of the line 30 and the arrangement 24. Whenever one of the flame reporters finds that its conditions of response are still fulfilled, then the time predetermined for the outflow of the extinguishing agent is extended by the time which had passed up to this point from the beginning of the extinguishing process. This process is repeated until final extinguishing of the fire.

guishing process as described. For the sake of illustration of the control of an automatic fire extinguishing installation according to the invention, FIG. 3 shows schematically the course of functioning from the beginning of the fire reports in the reporting lines 10 and 12 up to the extinguishing and automatic secondary extinguishing.

Figure 3:
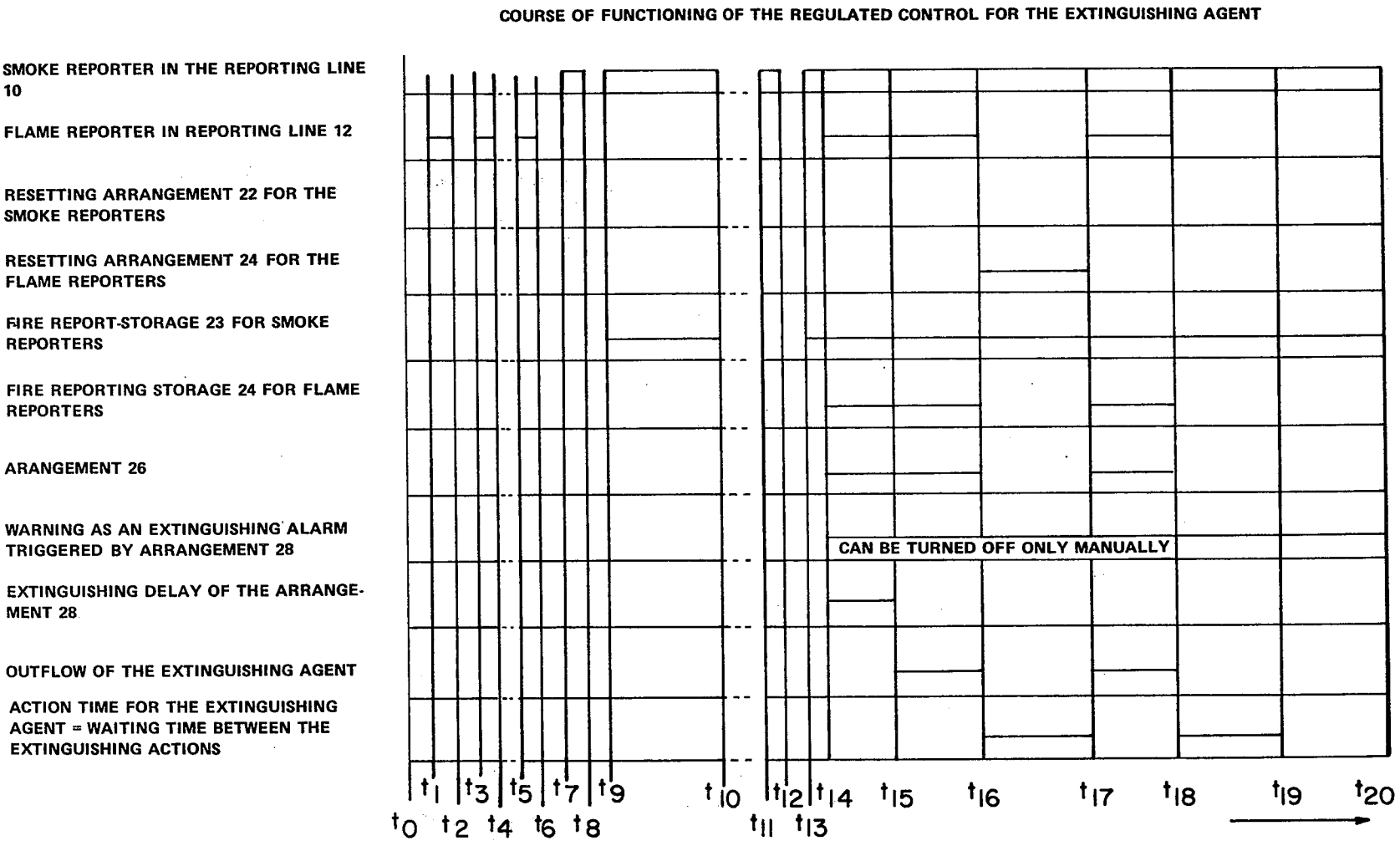
FIG. 3 shows the course of the functioning of the regulated control of the extinguishing agent.

Legend for the Diagram According to FIG. 3 "Course of Functioning of the Regulated Control for the Extinguishing Agent"

| | | |
|---|---|---|
| Point in time | $t_0$ | : Reporter and extinguishing installation are ready to function |
| " | $t_1$ | : 1st response of a flame reporter |
| " | $t_2$ | : Fire report of the flame reporter is reset |
| " | $t_3$ | : 2nd response of a flame reporter |
| " | $t_4$ | : Fire report of the flame reporter is reset |
| " | $t_5$ | : n-time response of a flame reporter |
| " | $t_6$ | : Fire report of the flame reporter is reset |
| " | $t_7$ | : First response of a smoke reporter |
| " | $t_8$ | : Fire report of the smoke reporter is reset |
| " | $t_9$ | : 2nd response of a smoke reporter; the fire report of the smoke reporter is stored in arrangement 23 for the predetermined time (time between $t_9$ and $t_{10}$) |
| " | $t_{10}$ | : Fire report of the smoke reporter is reset, since during the predetermined storage time (time between $t_9$ and $t_{10}$) none of the flame reporters has responded; the reporter and the extinguishing installation are again in their original state of readiness to function. |
| " | $t_{11}$ | : Response of a smoke reporter |
| " | $t_{12}$ | : Fire report of the smoke reporter is reset |
| " | $t_{13}$ | : Renewed response of a smoke reporter; a fire report of the smoke reporter is stored in arrangement 23 |
| " | $t_{14}$ | : Response of a flame reporter; fire report of the flame reporter is stored in arrangement 24; the simultaneous presence of fire reports in the storages 23 and 24 leads to triggering of the arrangement 26 which controls the arrangement 28; arrangement 28 triggers an alarm arrangement which requests leaving the extinguishing areas; the completion of the delayed time provided in arrangement 28 for the outflow of the extinguishing agent begins. |
| " | $t_{15}$ | : The delay in extinguishing (time between $t_{14}$ and $t_{15}$) has run its course; arrangement 28 controls arrangement 29, which opens the closing element 19 for the extinguishing agent for the predetermined time. |
| " | $t_{16}$ | : Predetermined time for the outflow of the extinguishing agent has run its course; action time for the extinguishing agent starts while the flame reporters are continuously reset. |
| " | $t_{17}$ | : End of the action time for the extinguishing agent and for resetting of the flame reporters; flame reporter still finds flames and issues a fire report; beginning of the automatic secondary extinguishing process. |
| " | $t_{18}$ | : End of the second extinguishing process and beginning of the predetermined action time during which the flame reporters are again continuously reset. |
| " | $t_{19}$ | : End of action time for the extinguishing agent and of the reset of the flame reporters; flame reporter finds no more flames and does not issue any more fire reports. |
| " | $t_{20}$ | : Smoke reporters no longer find smoke and issue no more fire reports; after a manual return of the alarm system, the controlled extinguishing installation is again in the state of readiness for functioning. |

The described and regulated fire extinguishing installations could fail in the case of a fire if there were a breakdown in one of the reporting lines 10 or 12 which makes impossible a fire report by the reporters of this line. In order to exclude this disadvantage, one can make provisions in the installation that every breakdown in the reporting lines is evaluated just like a fire report. Then, in case of breakdowns in one reporting line, the response of reporters in the not broken down reporting line by itself would bring about the extin-

EXAMPLE 1

Figure 4:
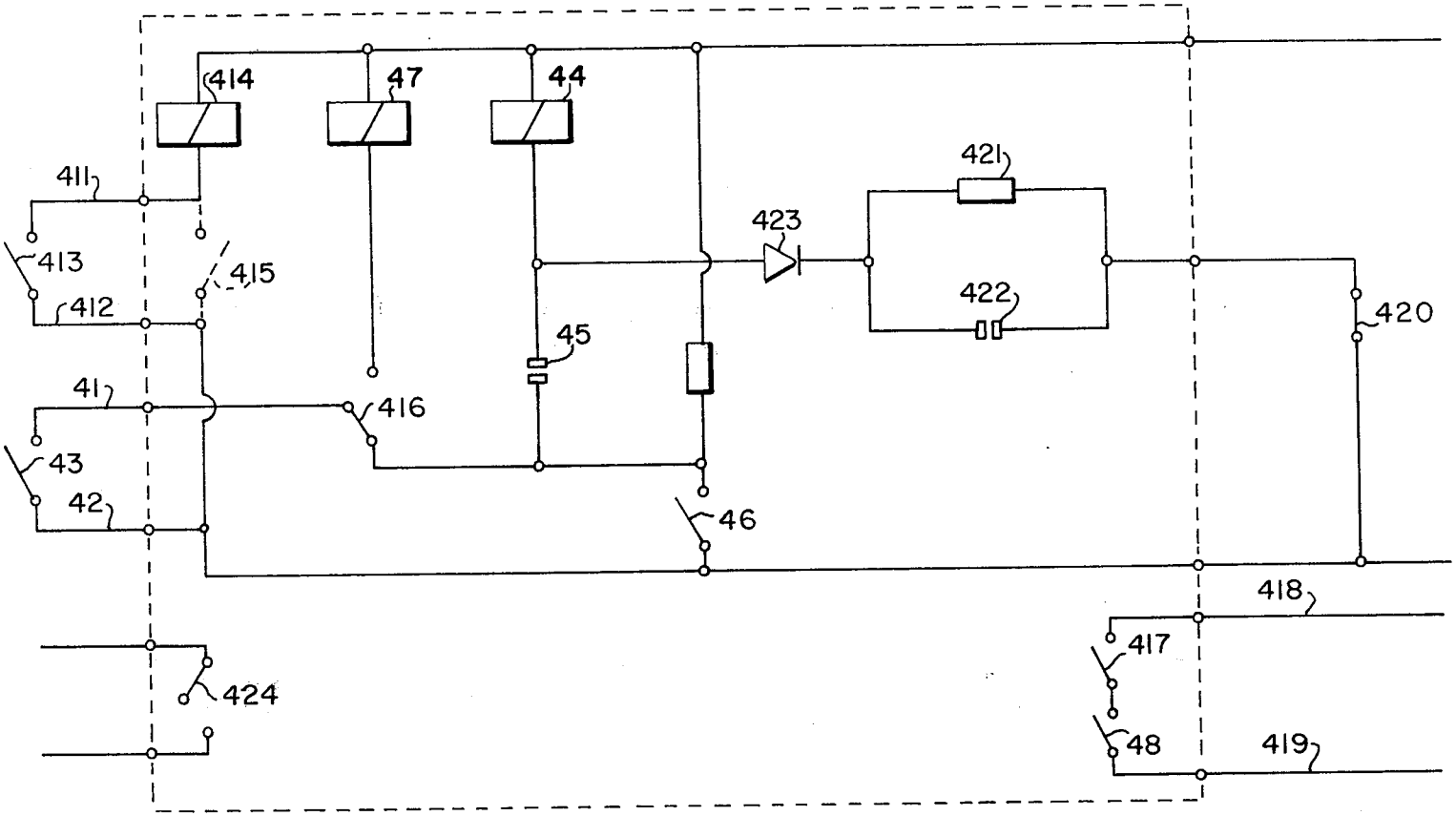
FIG. 4 shows a schematic of a control diagram for installations using gaseous extinguishing agent.

In FIG. 4 a flow diagram for an additional device is shown schematically with which even existing extinguishing installations for gaseous extinguishing agents can be changed over in such a way that they can be operated according to the process of the invention. It is assumed that these installations have a smoke or heat differential reporting line and a radiation reporter-reporting line. The connections 411 and 412 are connected with a contact of the alarm relay of the smoke or heat differential reporting line which is free of potential, whereas the connections 41 and 42 are conducted to a corresponding contact of the alarm relay of the radiation reporter-reporting line. As the result of an alarm report of a radiation reporter, the pertinent alarm relay is excited (energized) and the contact 43 is closed. As the result of that, the return relay 44 is energized by way of the capacitor 45 for a short period of time and closes the contact 426 through which the radiation reporter is again returned to its normal operating state. As a result of that the contact 43 is opened because of the drop of the pertinent alarm relay. If, however, a smoke or heat differential reporter has delivered an alarm report prior to the alarm report of a radiation reporter, the associated alarm relay closes the contact 413 by way of which the relay 414 is energized, which can move into a self-sealing state by closing of the contact 415 in case that this contact 415 has been provided. The contacts 416 and 417 are also closed by this relay 414. In the case of response of a radiation reporter, the contact 43 is closed in this state and the relay 47 is energized while contact 416 is closed, which relay closes the contact 48 and thus issues the command for extinguishing, which is passed on by way of the connections 418 and 419 to the control arrangement of the extinguishing installation. After completion of a predetermined preliminary warning time, which must be maintained in the case of use of gaseous extinguishing agents, the first quantity of extinguishing agent is released by way of the control arrangement. The extinguishing relay of this control arrangement, after its activation, closes in addition the contact 420 as a result of which the relay 44 picks up by way of the combination of the resistor 421 and capacitance 422 as well as via the diode 423 for a brief period of time and resets the radiation reporters in a manner already described. Whenever the fire is not extinguished by means of the released quantities of extinguishing agent and a radiation reporter again responds, the switching process is repeated with the closing of the contact 43 and again triggers the release of a further quantity of extinguishing agent. This course of functioning is repeated until the fire is extinguished and consequently a radiation reporter does no longer respond or until the supply of extinguishing agent is exhausted.

EXAMPLE 2

Figure 5:
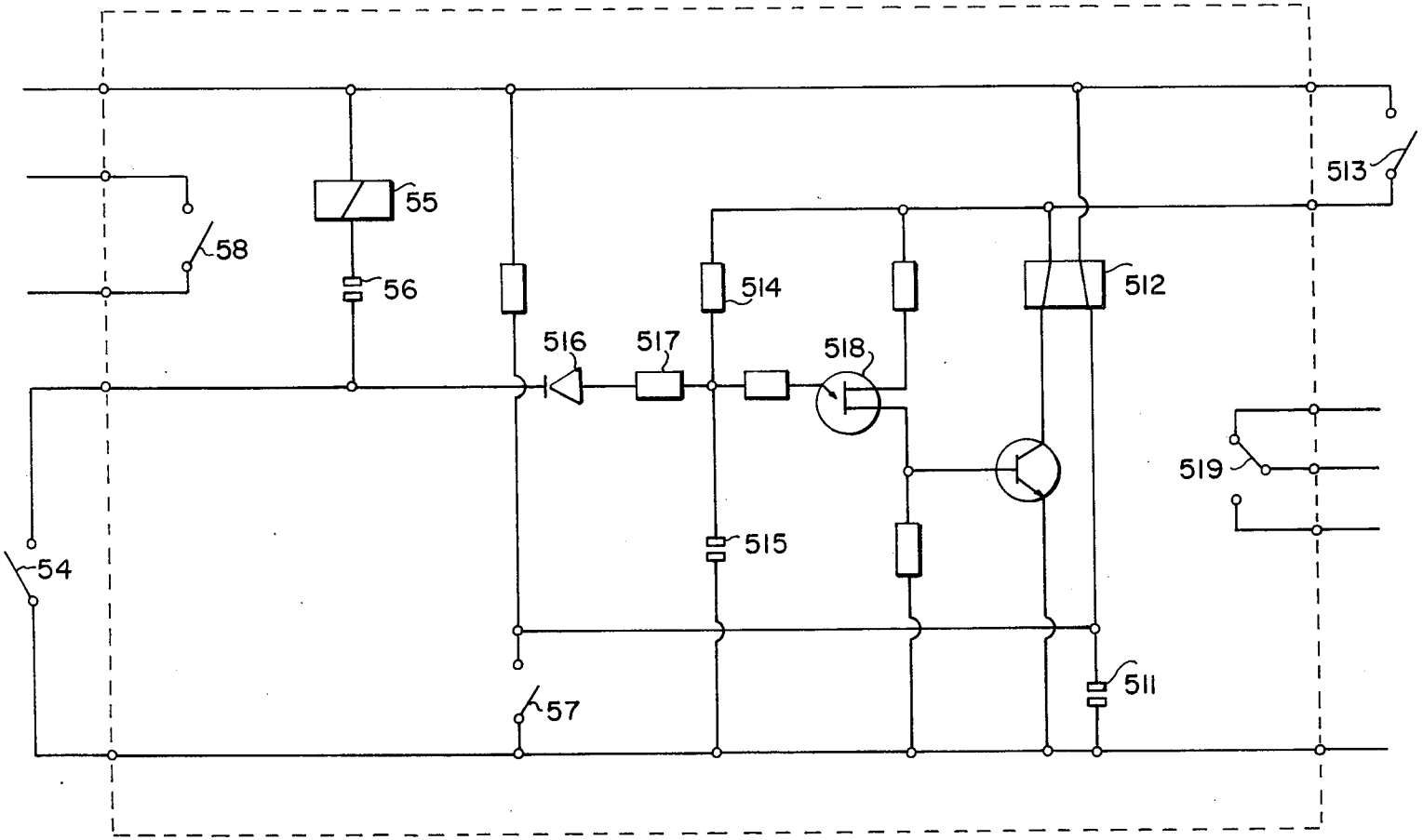
FIG. 5 shows a schematic of a control diagram for installations using sprinklers.

In FIG. 5, the flow diagram of an extinguishing control according to the invention is shown schematically which can be used for sprinkler installations. The overall installation is to be conceived in such a way that it has at least two radiation reporters protected against the effects of heat and that electric breakdowns of the reporter installation are used as criteria for delivering the alarm. The valve with regulates the inflow of the extinguishing agent to the sprinklers must be opened in the case of these installations in their normal operating state. The state of rest is achieved by application of the voltage to the switching system shown as a result of the fact that the relay 512 is briefly energized by way of the capacitance 511 and is moved into the position "extinguish". As a result of that the locking valve of the sprinkler installation opens. If in this state of switching only one radiation reporter responds, then the contact 54 is closed and the return relay 55 is energized by way of capacitance 56 and is attracted for a short period of time via the contact. The return relay closes the contact 58 through which the radiation reporter and thus the contact 54 is again brought into the normal operating state. Whenever a sprinkler bursts, for example, as a result of heat, then the alarm valve of the sprinkler installation opens and closes the associated alarm contact 513. Thus the path of the current via the resistance 514 and the capacitance 51 becomes free. If in this state of connection a radiation reporter responds, then the capacitance 515 is also discharged with resetting said reporter by way of the diode 516 and the resistance 517 so that the transistor 518 cannot drive. The delivery of the extinguishing agent triggered by the opening of a sprinkler is not interrupted until the report of the radiation reporter fails to come. In that case and after a predetermined time, the capacitance 515 is charged by way of the resistance 514 and until the transistor 518 drives. The impulse emanating from this transistor 518 drives the transistor 519 and moves the relay 512 into the position "switch off". Whenever the radiation reporter in this state of operation again releases an alarm signal, then the contact 54 also closes again and energizes the relay 512 which moves into the position "extinguish" and again opens the control valve by way of the contact 519.

What is claimed is:

1. A process having a fire reporting system which controls a locally fixed fire extinguishing installation for the automatic reporting and extinguishing of fires, said process comprising A. receiving and storing for a first predetermined time period a first report of a fire from a first fire reporter, B. receiving and storing a second report of the fire from a second fire reporter within the first predetermined time period, C. operating the locally fixed fire extinguishing installation to release a first quantity of extinguishing agent in response to steps A and B, D. after a second predetermined time period, determining whether the fire is extinguished, and E. repeating steps C and D until the fire is extinguished.

2. The process of claim 1 wherein the first fire reporter is a smoke reporter or a heat reporter and the second fire reporter is a flame reporter, said process further comprising immediately resetting the flame reporter after its report except when fire reports are received according to steps A and B in order to avoid a false alarm.

3. The process of claim 2 wherein the flame reporter is an infrared flame reporter.

4. The process of claim 2 wherein the first report consists of one signal when the first fire reporter is a heat reporter or of two signals within a third predetermined time period when the first fire reporter is a smoke reporter, said process further comprising blocking the immediate resetting of the flame reporter when the first report has been received.

5. The process of claim 1 further comprising delaying the release of extinguishing agent for a fourth predetermined time period, and warning individuals for purposes of evacuation prior to the release of extinguishing agent.

6. The process of claim 1 further comprising recording the first report in a central station.

7. In an automatic fire reporting and extinguishing system comprising a central station; fire reporting means for reporting a fire to said central station; fire extinguishing means for releasing a fire extinguishing agent to extinguish the fire in response to a signal from said central station; and control means for regulating the release of extinguishing agent according to a predetermined plan; the improvement which comprises: said fire reporting means comprising a first fire reporter and a second fire reporter, said first and second fire reporters each reporting to said central station by a separate reporting line, said first fire reporter comprising a smoke reporter or a heat reporter, and said second fire reporter comprising a flame reporter; said central station comprising smoke reporter resetting means for cancelling a first signal from said smoke reporter unless a second signal from said smoke reporter is received within a predetermined time period; report storage means for storing a first fire signal from said first fire reporter and a second fire signal from said flame reporter; flame reporter resetting means for cancelling said second fire signal from said flame reporter unless received by said central station within a second predetermined time period after receipt of said first fire signal; blocking means for blocking the operation of said flame reporter resetting means during said second predetermined time period after said central station receives and stores said first fire signal in said report storage means; and means including an AND gate for initiating the release of extinguishing agent when said report storage means simultaneously has said first fire signal and said second fire signal stored therein.

8. The automatic fire reporting and extinguishing system of claim 7, wherein said central station further comprises a delay means for delaying the relese of extinguishing agent for a third predetermined time period in order to evacuate a fire area.

9. The automatic fire reporting and extinguishing system of claim 7, wherein said delay means further comprises an alarm means for delivering a warning signal to said fire area, said alarm means having a manual shut-off.

* * * * *